United States Patent [19]

Free et al.

[11] Patent Number: 5,024,200

[45] Date of Patent: Jun. 18, 1991

[54] VISCOSITY RESPONSIVE PRESSURE REGULATOR AND TIMING CONTROL TAPPET SYSTEM INCORPORATING THE SAME

[75] Inventors: Paul D. Free; B. Doszpoly, both of Columbus, Ind.; Tibor J. Villanyi, Hanahan, S.C.; David A. Olson, Columbus, Ind.

[73] Assignee: Cummins Engine Company, Inc., Columbus, Ind.

[21] Appl. No.: 385,745

[22] Filed: Jul. 27, 1989

[51] Int. Cl.[5] ..... F02M 37/04

[52] U.S. Cl. ..... 123/501; 123/381; 123/502

[58] Field of Search ..... 123/500, 501, 502, 385, 123/386, 387, 381; 73/119 A, 55

[56] References Cited

U.S. PATENT DOCUMENTS

| | | | |
|---|---|---|---|
| 1,863,090 | 6/1932 | Albersheim et al. . | |
| 2,035,951 | 3/1936 | Eckstein . | |
| 2,050,242 | 8/1936 | Booth . | |
| 2,051,026 | 8/1936 | Booth . | |
| 2,194,605 | 3/1940 | Mapel . | |
| 3,170,503 | 2/1965 | Isley | 123/381 |
| 3,859,973 | 1/1975 | Dreisin | 123/386 |
| 3,938,369 | 2/1976 | de Bok . | |
| 4,249,499 | 2/1981 | Perr . | |
| 4,304,205 | 12/1981 | Bauer | 123/501 |
| 4,306,528 | 12/1981 | Straubel | 123/501 |
| 4,355,621 | 10/1982 | Yasuhara | 123/502 |
| 4,419,977 | 12/1983 | Hillebrand | 123/502 |
| 4,889,092 | 12/1989 | Bostwick | 123/381 |

FOREIGN PATENT DOCUMENTS

| | | | |
|---|---|---|---|
| 0165636 | 10/1982 | Japan | 123/500 |

*Primary Examiner*—Carl Stuart Miller

*Attorney, Agent, or Firm*—Sixbey, Friedman, Leedom & Ferguson

[57] ABSTRACT

A flow controlling system having a viscosity sensitive means for producing a simulated fluid pressure which varies in correspondence with a fluid pressure at a predetermined portion of a fluid flow circuit on the basis of the viscosity of the fluid flowing through the circuit, and a pressure regulating means, that is responsive to changes in the simulated pressure, for maintaining a predetermined pressure at that predetermined portion of the fluid flow circuit. In particular, in a preferred embodiment of the invention, the flow controlling system is utilized in an engine timing control tappet system of the type having at least one expansible tappet for controlling timing of a fuel injector using oil that is supplied by a pump to an engine lubrication circuit.

19 Claims, 6 Drawing Sheets

VISCOSITY RESPONSIVE PRESSURE REGULATOR AND TIMING CONTROL TAPPET SYSTEM INCORPORATING THE SAME

TECHNICAL FIELD

This invention relates to a means for adjusting the pressure of lubricating fluid in an engine lubrication circuit responsive to the viscosity of lubricating fluid flowing in the circuit. Additionally, this invention relates to a means for maintaining sufficient pressure of timing fluid at engine timing control tappets.

BACKGROUND ART

It has long been known to use engine lubrication oil to advance or retard the timing of fuel injection in a diesel engine. A timing control arrangement similar to the type contemplated for use with the present invention is shown in FIG. 1. As disclosed in U.S. Pat. No. 4,249,499 to Perr, the fuel injector shown in FIG. 1 includes a cam shaft 1 carrying cam lobes 3 and 5 for operating a rocker arm 7 via a link 9. Rotation of cam shaft 1 causes rocker arm 7 to rotate about shaft 11 to reciprocate injector plunger 13 via the link 9 and timing control tappet 15. Although normal timing is ideal for a range of engine connected operating conditions, it results in incomplete combustion during idling and low engine speeds because of insufficient pressure in the combustion chamber. Incomplete combustion results in high hydrocarbon emissions and low fuel economy, problems that can be alleviated by injecting fuel into the combustion cylinder sooner.

In the fuel injector shown in FIG. 1, advanced timing is achieved by introducing timing fluid into a timing chamber 17, thereby producing a height of fluid which lengthens the link between rocker arm 7 and injector plunger 13. As a result of this lengthened linkage, injector plunger 13 reaches its bottom-most position at an earlier point in the rotation of cam shaft 1. Accordingly, fuel injection occurs at a point in the combustion cycle when the piston of the engine is still moving upward, and while the combustion chamber size is still decreasing This advancement of injection produces combustion at higher pressures than normal timing because during normal timing injection occurs at a point close to the top dead center position of the piston, and most combustion takes place while the piston is moving downward to increase the combustion chamber size.

The specific operation of timing advancement will become more clear from a study of FIGS. 2 and 3 as compared with FIG. 1. FIG. 1 illustrates the injector parts at the end of an injection stroke wherein plunger 13 is in the down position Note that timing chamber 17 contains a metered amount of timing fluid, which has advanced the downward movement of plunger 13. FIG. 2 illustrates the timing control tappet of FIG. 1 after timing fluid has drained from chamber 17 and injector plunger 13 has retracted to a position above the point when timing fluid enters timing chamber 17. FIG. 3 illustrates the actual metering of fluid into chamber 17.

Whether and how much timing fluid will be supplied to the timing chamber 17 of the tappet is a function of the pressure of the timing fluid. When the pressure of the timing fluid supply is insufficient to overcome the closure force of check valve 18 in passageway 19, no timing fluid is admitted to chamber 17. Furthermore, the extent to which the pressure of the timing fluid supply exceeds that necessary to open the check valve

18 determines how much timing fluid will actually enter chamber 17. Thus, because timing chamber 17 can be filled during only a limited portion of the cycle of camshaft 1, if adequate supply pressure is not maintained, even if check valve 18 opens, a proper timing advance will not be obtained. However, due to temperature effects upon the viscosity of the timing fluid, especially the lubricant normally used as a timing fluid, sufficient pressure to properly fill the timing control tappets has been very difficult to achieve under all operating conditions with the prior art devices.

For example, in an embodiment of the prior art tappets, shown in FIGS. 1–3, engine lubrication oil is used as the timing fluid, cold engine lubrication oil is highly viscous. Thus, when the lubrication oil is cold, the timing chamber 17 may fill only partially during the portion of the cycle allowing flow through passageway 18, so that timing is only partially advanced. Moreover, during operation with very cold lubrication oil (i.e., in the range below 0 degrees F.), timing chamber 17 may not fill at all. In such a situation, even though advanced timing may be desired, normal timing nonetheless results. Failure to properly obtain the appropriate timing advance leads to such undesirable effects as incomplete combustion, poor idling characteristics, low fuel economy, and the emission of white smoke which is high in hydrocarbons.

As illustrated by the solid line in FIGS. 4 and 5, even though the oil pressure at engine block drillings of the lubrication system is maintained constant (FIG. 5), the oil pressure at the tappets in prior art devices does not reach the necessary pressure level, indicated by the broken line in FIG. 4, until the engine warms up and oil viscosity, drops Therefore, until a temperature corresponding to point A in FIG. 4 is reached, the advanced timing function is not properly performed due to the pressure drop caused by the cumulative boundary layer effects resulting from pumping very thick oil through relatively narrow passageways.

Devices for measuring oil viscosity are known as disclosed in U.S. Pat. No. 1,863,090 to Albersheim et al and U.S. Pat. No. 2,050,242 to Booth. Neither of these devices, however, effects a change in the pressure of oil responsive to its viscosity. Although Booth recognizes that more pressure is required for the flow of more viscous oil, neither patent discloses means for increasing oil pressure to critical engine parts when viscosity increases are observed.

U.S. Pat. No. 2,194,605 to Mapel and U.S. Pat. No. 2,035,951 to Eckstein disclose other apparatus for measuring oil viscosity. Mapel recognizes that a greater pressure must be used to effect the same rate of flow for thick oil, but uses this relationship only as an indication of viscosity. Mapel does not change oil pressure in response to high viscosity oil.

U.S. Pat. No. 3,938,369 to de Bok discloses an invention which heats a fluid until a desired viscosity is achieved Although de Bok establish desirable flow characteristics upon sensing an undesirable viscosity level, the de Bok device requires a heater for heating the fluid until a desired viscosity is obtained which would be otherwise unnecessary, and thereby would increase the costs of manufacturing and maintaining an engine. Furthermore, although a heater may provide sufficient heat to achieve the proper viscosity of small amounts of fuel, as is de Bok's purpose, such a heater would be incapable of heating the quantity of oil required for lubrication in a diesel engine in a fast enough time to provide the degree of responsiveness that would be required to be useful for achieving proper operation of variable timing tappets.

U.S. Pat. No. 2,051,026 to Booth discloses an engine lubricating system designed to supply lubricating oil to the engine bearings at uniform viscosity in which only a small amount of oil from a hot oil sump is circulated through the engine when the engine is started, and as viscosity drops, oil is also admitted to the lubrication system from a larger, cold oil sump in a manner designed to hold the oil at a temperature which will yield the correct oil viscosity. Although this arrangement provides an almost immediate supply of oil of a desired viscosity to the bearings, the arrangement is disadvantageous because it requires two oil sumps (one hot and one cold) and associated controls, sensors, and piping for mixing hot and cold oil to achieve the desired viscosity. Furthermore, such a necessarily small hot oil sump is not designed to meet the needs of a tappet system of the type initially mentioned.

In short, no apparatus is known which not only senses the viscosity of lubricating oil, but also adjust the output pressure from a lubrication oil pump in response thereto. Particularly, there is no apparatus known that increases the pressure of oil delivered to timing control tappets upon sensing that the oil viscosity is above a predetermined level to ensure proper operation of the timing control tappets.

DISCLOSURE OF THE INVENTION

The primary object of the subject invention is to provide a diesel engine which provides favorable cold start-up performance of an advanced fuel injection timing system.

Another object of the subject invention is to provide a flow circuit for a lubrication fluid wherein a constant pressure is maintained in a viscosity sensitive portion of the flow circuit.

A more particular object of this invention is to increase oil pressure to expansible engine tappets when oil is highly viscous to ensure sufficient flow characteristics to expand the height of the expansible engine tappets to a desired level in order to provide proper engine timing.

A still more specific object of the invention is to adjust the oil pressure at the tappets in response to a pressure drop in a chamber simulating the pressure at the tappets.

Other objects of the invention include improving cold-weather idling characteristics, reducing the emission of white smoke during cold start-up, meeting the strict hydrocarbon emission standards of the Environmental Protection Agency, improving light-load fuel economy, and reducing injector carboning by ensuring proper engine timing despite variations in the viscosity of timing fluid used to control injector timing.

The above and other objects in accordance with the present invention are achieved through the use of a flow controlling system having a viscosity sensitive means for producing a simulated fluid pressure which varies in correspondence with a fluid pressure at a predetermined portion of a fluid flow circuit on the basis of the viscosity of the fluid flowing through the circuit, and a pressure regulating means, that is responsive to changes in the simulated pressure, for maintaining a predetermined pressure at that predetermined portion of the fluid flow circuit. In particular, in a preferred embodiment of the invention, the flow controlling system is utilized in an engine timing control tappet system of the type having at least one expansible tappet for controlling timing of a fuel injector using oil that is supplied by a pump to an engine lubrication circuit.

More specifically, an oil rifle connection is provided between the engine lubrication circuit and the viscosity sensitive means. Oil entering the viscosity sensitive means from the oil rifle connection is caused to pass through a viscosity orifice to a pressure chamber, from which it may travel to a drain line via an exit orifice that controls the quantity of fluid that passes through the viscosity orifice. The viscosity orifice has a flow-through length and cross-sectional area that produces a pressure drop from an upstream to a downstream side thereof that is sensitive to changes in viscosity of oil passing therethrough, while the exit orifice has, in comparison to the viscosity orifice, a relatively short flow-through length and relatively small sensitivity to the viscosity of oil passing therethrough.

For enabling the pressure in the lubrication circuit to be regulated, a regulator connection communicates the pressure regulating means with the pressure chamber. Thus, the pressure regulating means is able to respond to viscosity-dependent changes in pressure occurring in the pressure chamber (which correspond to the pressure changes occurring at the tappets) so as to increase/decrease the pressure of the flow from the pump by regulating a bypass drain connection.

These and other features, advantages and objects of the invention will become more apparent from the following detailed description of the best mode of carrying out the invention when viewed in conjunction with the accompanying drawings.

BEST MODE FOR CARRYING OUT THE INVENTION

Figure 6:
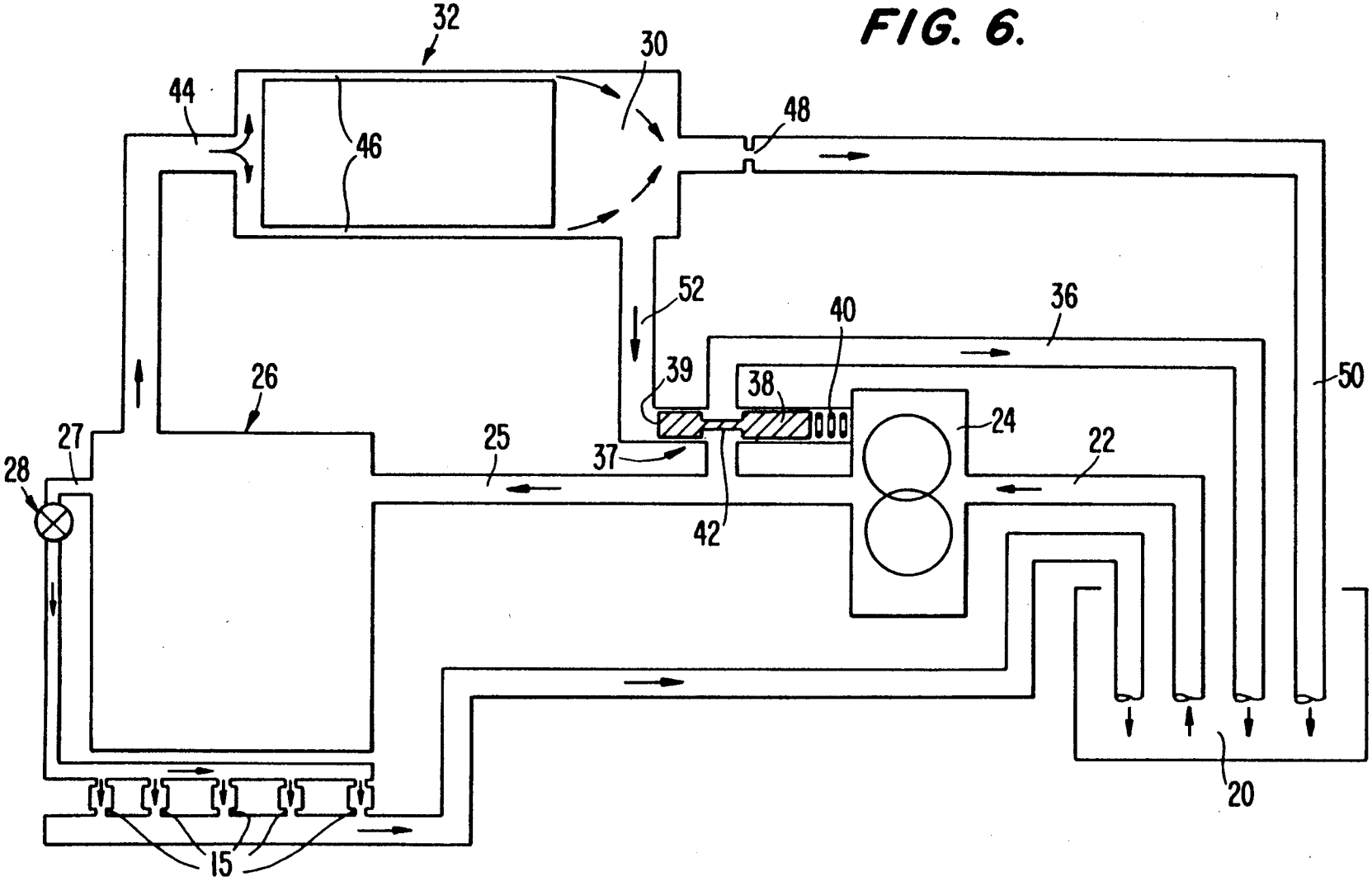
FIG. 6 is a schematic depiction of an engine timing tappet control system in accordance with the present invention.

The preferred embodiment of the present invention may best be understood through a study of FIG. 6 wherein an engine timing tappet system is schematically illustrated. In this system, the engine lubricant is also used as a timing fluid for advancing the engine timing essentially as described previously in reference to U.S. Pat. No. 4,249,499. However, a major difference between the system of the present invention and that of the noted patent is that pressure to the lubrication system is not maintained constant. To the contrary, the present invention deliberately varies the lubrication system pressure in order to insure that, even with cold engine lubricant, despite pressure losses, the pressure of the fluid supplied to the tappets will be maintained at the proper level to achieve the desired operation of the expansible tappets. Since the proper pressure is maintained at the tappets regardless of oil temperature, proper advanced timing can be effected even at very low temperatures (i.e., at least down to 0 degrees F.).

Any commercially available engine oil may be used as both the lubricant and timing fluid in the engine lubrication circuit of FIG. 6. In normal use, a medium viscosity oil such as 15W–40 would typically be used. Oil is pumped from an oil pan 20 through a conduit 22 by a gear pump 24. Gear pump 24 is designed to always provide a constant flow of oil, as is conventional in the art. This flow is more or less independent of the pressure at which the oil is pumped. Oil leaving the gear pump flows via conduit 25 to lubricate and cool the engine by way of drillings (not shown) within engine block 26. Additionally, an oil rifle 27 feeds timing control tappets 15. The timing control tappets 15 are connected in parallel with the engine block drillings, and flow to the tappets is controlled by an electrical signal which can, for example, maintain a valve 28 in either a closed position for normal timing or in an open position for advanced timing.

Valve 28 may, for example, be a solenoid controlled valve to facilitate valve control from a location remote from the valve. Valve 28 could also be controlled from a control center which monitors and controls a plurality of engine operations. With valve 28 open, injection into the combustion cylinder of the present invention is generally effected at a crankshaft angle before top dead center is reached. As an example, in a diesel engine, injection during advanced timing may be effected at 2 degrees before top dead center as compared with a crankshaft angle of 9 degrees past top dead center for normal timing. The angle at the point of injection is, of course, different for different engine models because injection timing is designed based on the compression ratios and the horsepower produced by a particular engine.

As described earlier, at low temperatures, the high viscosity of cold lubrication oil results in a very large pressure drop across the system. While a way to remedy this problem would be to provide a constant pressure at the tappets by sensing the pressure of the lubrication oil there, rather than at the engine block drillings, unfortunately, the tappets are relatively inaccessible and they only see pressure when valve 28 is open, i.e., during advanced timing. As a result, a reliable pressure reading cannot be obtained at the tappets.

For this reason, the changes in pressure experienced by the tappets due to temperature related variations in viscosity of the lubrication oil is simulated in a pressure sensing chamber 30 of a viscosity sensitive means 32, which will be explained in more detail below.

The pressure of flow through a conduit 25 is regulated by the diversion of some of the flow output from pump 24 into a bypass loop 36 which forms a drain connection to oil pan 20. The more oil that is diverted through bypass loop 36, the lower the pressure flowing through engine conduit 25.

In a preferred embodiment of the present invention, the diversion of flow into bypass loop 36 is regulated by a pressure regulator 37 having a pressure regulating plunger 38. In response to pressurized oil contacting the left face 39 of the pressure regulating plunger 38, it moves to the right against the force of a biasing spring 40. In response to low pressure contacting the left face 39 of pressure regulating plunger 38, biasing spring 40 pushes the plunger to the left.

Pressure regulating plunger 38 is constructed with a medial portion 42 of narrow cross-section which permits flow from gear pump 24 to enter bypass loop 36. As shown in FIG. 6, pressure regulating plunger 38 is in its extreme right position, allowing the maximum flow through bypass loop 36, and as the plunger 38 shifts leftward, it progressively reduces the flow through the bypass loop 36, thereby increasing the pressure in conduit 25. Pressure regulating plunger 38 is kept from moving farther to the right, in FIG. 6, by a mechanical stop (not shown). In a preferred embodiment of the invention, pressure regulating plunger 38 maintains a constant pressure of 40 psi±5 psi using 15W–40 oil at rated speed and operating temperatures above 180 degrees F, in the illustrated position.

That is, in order to insure that adequate oil pressure to properly fill the tappets with timing fluid exists at all operating temperatures, the left face 39 is exposed to pressure chamber 30 of the viscosity sensitive means 32 in which the pressure will vary in correspondence with the effect of temperature related variations in the viscosity of the lubrication oil on the pressure at the tappets.

To simulate the tappet pressure, an oil rifle or supply connection 44 provides a flow of lubrication oil at regulator output pressure, i.e., at a pressure corresponding to that supplied to the engine by conduit 25, to the viscosity sensitive means 32. For this purpose, the oil rifle that previously has been used as the pressure regulator control signal line may be used. The oil from this line is passed through a viscosity orifice 46 to pressure chamber 30, from which it flows via an exit orifice 48 to the oil pan 20 via a drain connection 50. The viscosity orifice 46 is of a flow-through length and cross-sectional area that will produce a pressure drop between the upstream and downstream sides thereof that varies with viscosity and flow rate, thereby enabling the instantaneous pressure in chamber 30 to vary even while regulator output pressure in conduit 25 remains constant. In this regard, it should be appreciated that the reaction time of regulator 37 is so fast that the pressure reading by a pressure gauge connected to chamber 30 would appear to show the pressure in chamber 30 holding constant while the pressure at the tappets 15 and oil rifle 44 is following the broken line curve to the left of point A in FIG. 5.

However, since a pressure drop cannot occur without flow, exit orifice 48 serves this function. Exit orifice 48 must be independent of the viscosity orifice eventhough it is downstream of it, in order that standard text book equations can be used to develop the dimensions of the orifices 46, 48. Thus, the exit orifice 48 should have a relatively short flow-through length and relatively small sensitivity to variations in viscosity. Also, the size of the exit orifice 48 is important in other respects. If the orifice 48 is too small, the viscosity sensing means will effectively be eliminated since the pressure in chamber 30 would become the line pressure set by regulator 37. On the other hand, If exit orifice 48 is too large, it will bleed off an unacceptable amount of the system capacity so as to reduce the amount of oil available for lubrication. Furthermore, if the exit orifice is too large, it will bleed off too much oil from pressure chamber 30, thereby causing the lubricating pump to deliver high oil pressure even under warm oil temperatures.

A regulator connection 52 communicates the pressure in pressure chamber 30 with the face 39 of the pressure regulating plunger 38 (shown in FIG. 6) via the port normally used to connect rifle 44 to regulator 37 in prior art systems. The instantaneous pressure produced in pressure sensing chamber 30 is a result of the design of viscosity orifice 46 and exit orifice 48 with regulator valve 37 reacting immediately to bring the pressure in chamber 30 back to the desired value. In addition to the above noted factors pertaining to these orifices, the following points are noted.

The responsiveness of the pressure drop across viscosity orifice 46 to a change in viscosity of lubrication oil flowing in the circuit is dependent upon its geometry and the geometry of exit orifice 48. It is important to design viscosity orifice 46 to be many times more viscosity sensitive than exit orifice 48. This is achieved by providing viscosity orifice 46 with a small cross-sectional flow-through area and a relatively large internal surface area in comparison with that of the exit orifice 48. The relatively large internal surface area of the viscosity orifice interacts with viscous lubrication fluid flowing therethrough, producing a substantial boundary layer effect and a corresponding drop in pressure across the orifice when the lubrication oil is cold.

On the other hand, the design of viscosity orifice 46 should be such that virtually no pressure drop occurs across the viscosity orifice 46 when the oil has reached normal operating temperature. That is when lubrication fluid has reached approximately 180 degrees F. (point A, FIGS. 4 5) very little pressure drop should result across viscosity orifice 46, and by at a temperature of 225 degrees F. or higher, the pressure drop across the viscosity orifice 46 should be so slight that the performance of an engine including the present invention is not noticeably different from the performance of a prior art engine without a viscosity sensitive means 32. In this way, the present invention improves cold weather engine performance but does not compromise performance when the engine is warm.

The radial clearance, inside diameter, and length of the viscosity orifice 46 are dependent upon the change in pressure desired for a particular viscosity of oil in the system. The exit orifice 48 is designed based on the volumetric flow rate through the viscosity orifice necessary to effect the desired pressure while maintaining a predetermined pressure level in pressure sensing chamber 30, and keeping in mind the other size related considerations already mentioned.

A preliminary estimate of appropriate viscosity orifice and exit orifice dimensions can be obtained by using textbook equations and viscosity tables, with a computer program utilizing the equations and tables to iteratively develop the optimum dimensions for the viscosity and exit orifices 46,48 for both cold and operating temperatures. Upon performing these calculations and testing orifices of various sizes, the objects of the present invention were found to best be achieved by certain ratios of the geometries of viscosity orifice 46 to that of exit orifice 48.

As a general rule, the ratio of the surface area of the viscosity orifice 46 to that of the exit orifice 48 will be at least 100 to 1, and the ratio of the cross-sectional flow-through area of these orifices will be at least 5 to 1. For example, the above objects of the invention were found to be accomplished satisfactorily using two different geometries for exit orifice 48. With an exit orifice 48 measuring 0.0330 inches in diameter and 0.015 inches in length, the following ratios of geometries of viscosity orifice 46 to exit orifice 48 produce satisfactory results.

| | |
|---|---|
| Surface area | 1400 to 1 |
| Flow area | 25 to 1 |
| Clearance | 0.6 to 1 |

With an exit orifice 48 measuring 0.040 inches in diameter and 0.085 inches in length, the following ratios of geometries of viscosity orifice 46 to exit orifice 48 are exemplary of the ratios producing satisfactory results.

| | |
|---|---|
| Surface area | 350 to 1 |
| Flow area | 18 to 1 |
| Clearance | 0.5 to 1 |

The above example ratios were determined in an attempt to model the pressure in pressure sensing chamber 30 to simulate the pressure at timing control tappets 15, and are nonexclusive. For example, in other cases, the viscosity orifice 46 and exit orifice 48 can be designed to produce a pressure drop across viscosity orifice 46 which does not equal the pressure drop to the timing control tappets.

That is the parameters of the invention can be varied so as to produce either a smaller or larger pressure drop across viscosity orifice 46. The pressure drop across viscosity orifice 46 can be made to be more aggressive for certain ranges of viscosity by changing the length or diameter of the viscosity orifice, or by varying the diameter of the balance orifice. In this way, the oil pressure to the timing control tappets can be maintained at a higher level at low temperature than it is for high temperatures. The higher oil pressure to the tappets can be used, for example, to force air from the lines when the engine is started initially.

Thus, while the simulated pressure produced in the pressure chamber 30 due to the pressure drop effect of viscosity orifice 46 will vary in correspondence with the viscosity change induced effects at the tappets, this simulated pressure will not necessarily be the same as that at the tappets, and may vary proportionately as opposed to directly in the same amount. Furthermore, in other circumstances, the invention may be modified so that the pressure in pressure sensing chamber 30 simulates the viscosity change effect on the pressure of oil supplied to some point in the engine and lubrication circuit other than the timing control tappets. In this way, the pressure regulator 37 can, then, adjust the supply pressure in a manner suited to that particular application of the invention.

Figure 7:
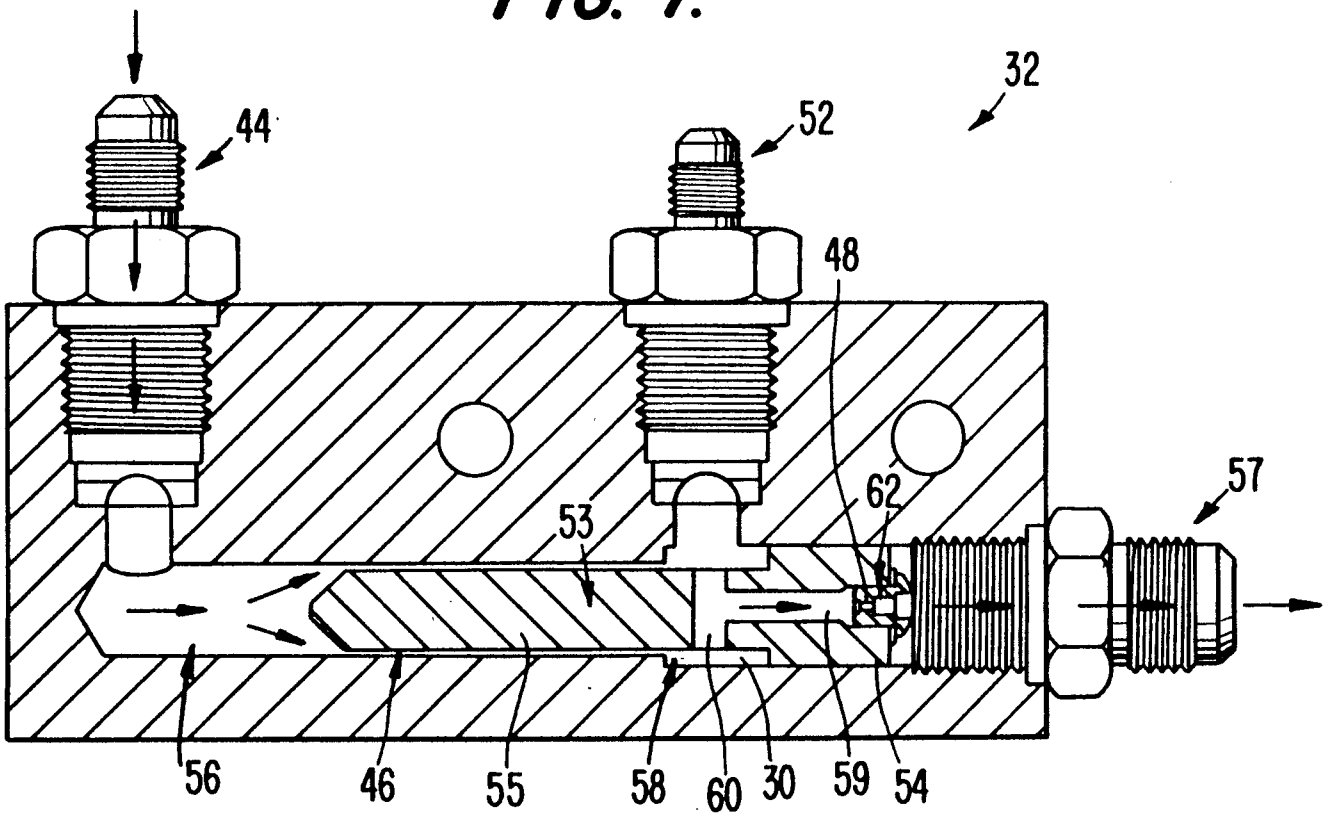
FIG. 7 is a cross-sectional view of a preferred embodiment of a viscosity sensitive pressure simulating means for the FIG. 6 system.

Referring to FIG. 7, a preferred embodiment viscosity sensitive means 32 is shown. In this case, an insert 53 having an end 54 and a cylindrical portion 55 is inserted into one end of a bore 56. The bore 56 is provided with a counterbore portion 58 that extends to a cross-drilling connecting to the regulator connection 52. End 54 of insert 53 is secured in counterbore portion 58 by a press fit, and the outer end of the counterbore portion 58 is internally threaded for fastenening the threaded end of a fitting 57 in place. Fitting 57 is used for attachment of drain connection 50. The cylindrical portion 55 has a reduced cross section and is concentrically disposed within the bore 56 so as to form an annular viscosity orifice 46 in conjunction with the surrounding wall of the inner portion of bore 56 that is located between the connection of the oil rifle 44 to the bore 56 and the connection of the counterbore portion 58 with the regulator connection 52.

Additionally, the pressure sensing chamber 30 is formed by the reduced diameter cylindrical portion 55 and the surrounding wall of the counterbore portion 58. Insert 53 also includes a diametric through-hole 60 which connects pressure sensing chamber 30 with an axial passage 59, within which an orifice member 62 forming the exit orifice 48 (which meters the flow draining back to oil pan 20 through drain connection 50) is disposed by being threaded within the outlet end of axial passage 59.

As represented by the arrows in FIG. 7, flow from the oil rifle 44 enters bore 56 and passes through viscosity orifice 46. Depending upon the viscosity of the oil, boundary layer effects will result in an appropriate pressure drop, which will decrease as the oil warms up until virtually no pressure drop occurs when the oil is hot. It can be appreciated the actual performance produced can be easily tailored and varied with this embodiment simply by replacing an insert 53 having a cylindrical portion 55 of one length and/or diameter with one having another length and/or diameter. Similarly, exit orifice forming inserts 62 of various sizes can also be interchanged within passage 59 of any insert 53 to afford further degrees of adaptability by controlling the amount of flow permitted to pass to the drain connection 50.

Figure 1:
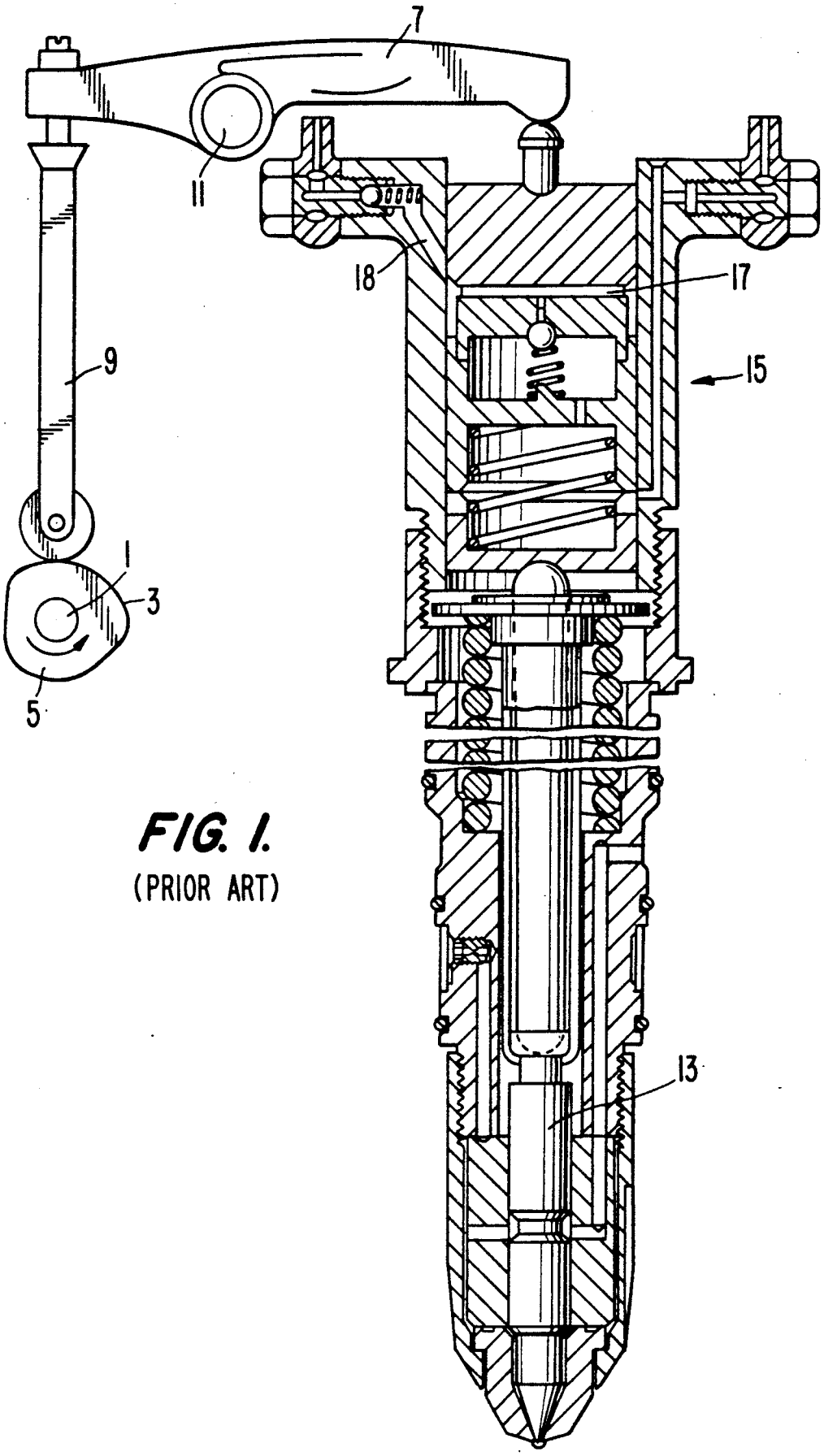
FIG. 1. (PRIOR ART)
FIG. 1 is a vertical cross-sectional view of a prior art fuel injector arrangement with an expansible tappet.
Figure 3:
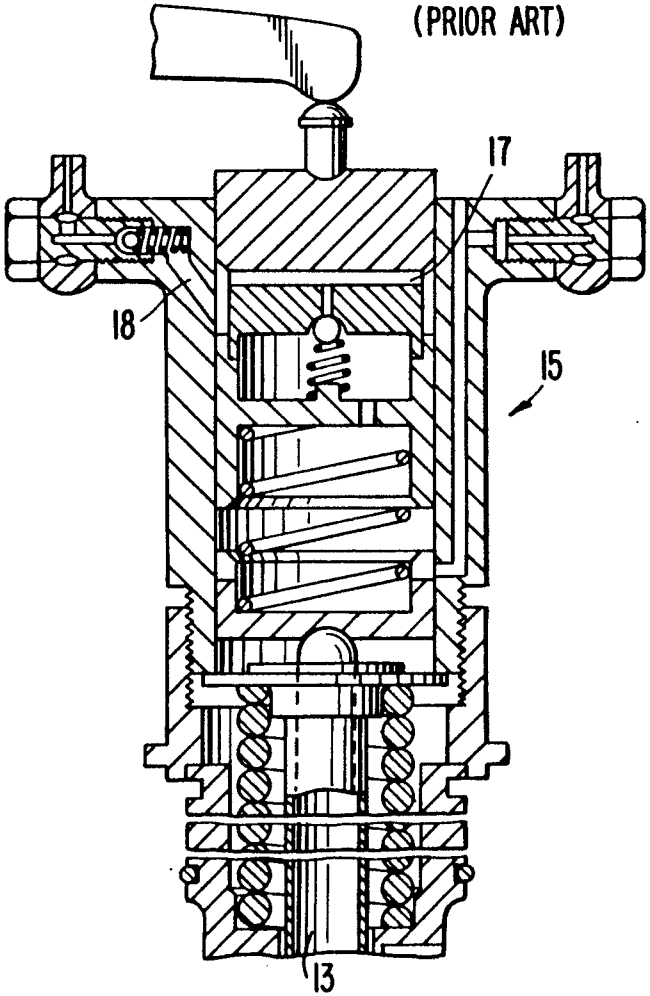
FIG. 3. (PRIOR ART)
FIGS. 2 3 are cross-sectional views of the expansible tappet of the FIG. 1 arrangement illustrating to different conditions of the tappet.
Figure 2:
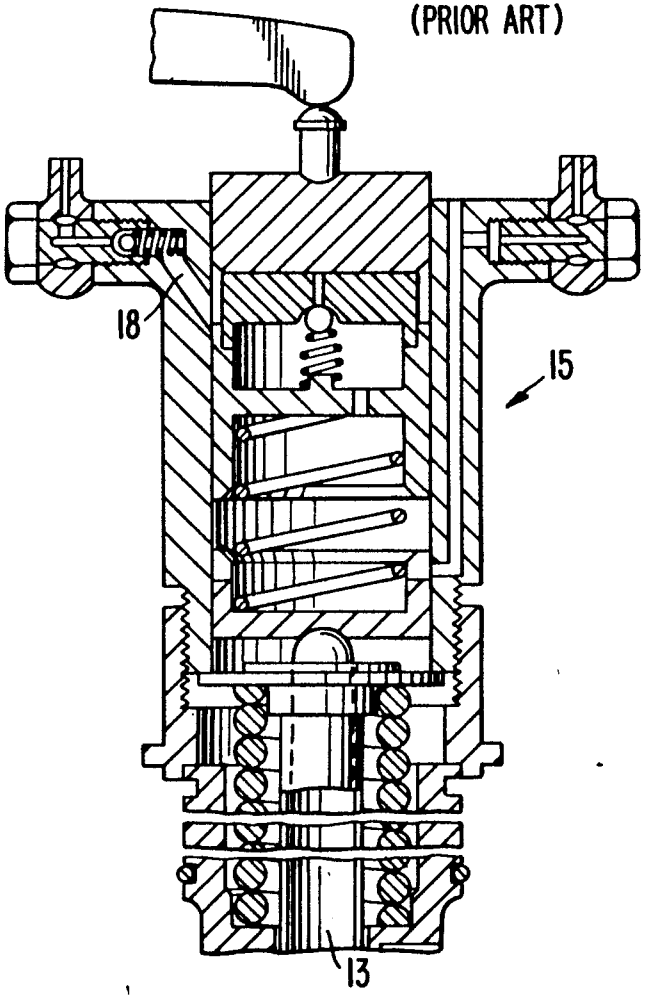
FIG. 2. (PRIOR ART)
Figure 4:
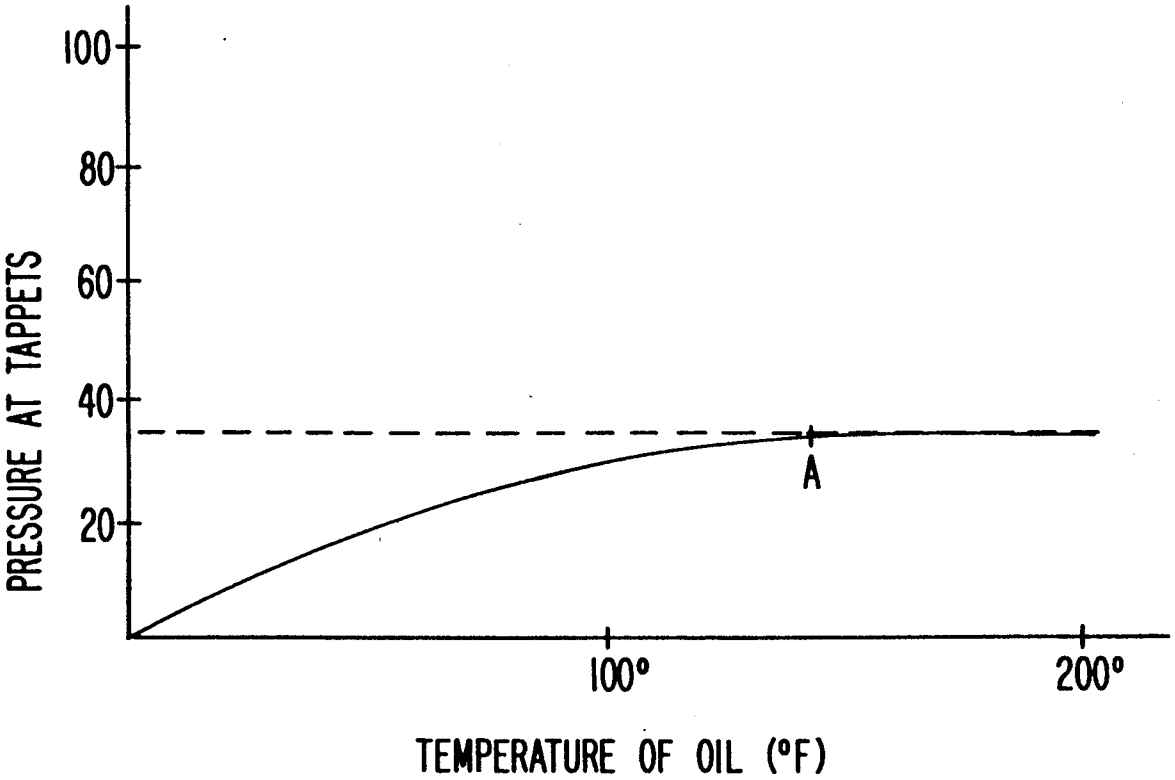
FIG. 4 is a graph depicting the relationship between pressure at the tappets and oil temperature for a prior art system (solid line) and the present invention (broken line)
Figure 5:
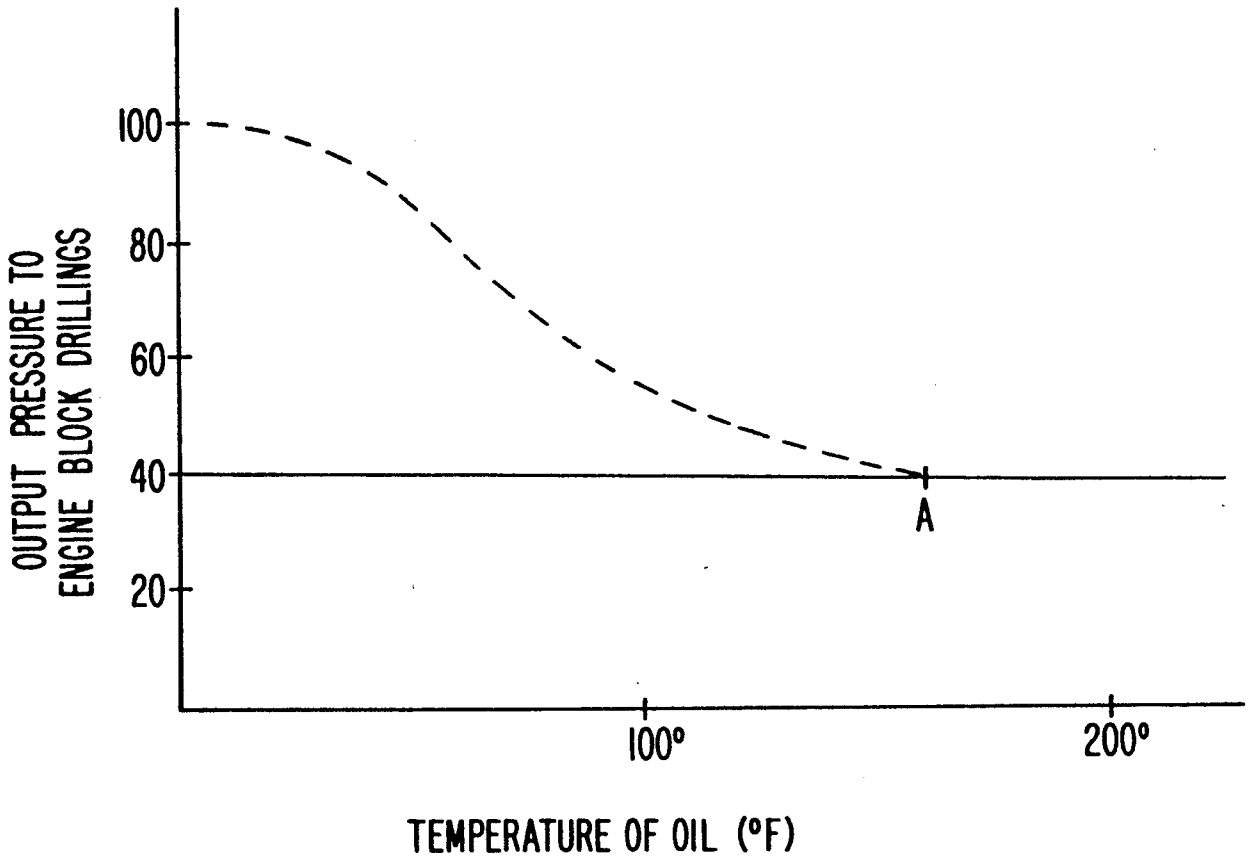
FIG. 5 is graph depicting the relationship between pressure to the engine block and oil temperature for a prior art system (solid line) and for the present invention (broken line)

As represented by the broken line curve in FIGS. 4 and 5, a constant pressure can be maintained at tappets 15, despite temperature related viscosity effects by producing a simulated pressure in pressure chamber 30 which will cause pressure regulator 37 to vary the output pressure to the engine block drillings as indicated by the broken line curve in FIG. 5. In this way, the pressure at the tappet can be assured of always producing a proper timing advance.

Industrial Applicability

The subject viscosity responsive pressure regulator will find particular utility in internal combustion engines to maintain a constant fluid pressure in any part of the engine lubrication circuit. The device has particular applicability to a hydraulically operated timing control system in a diesel engine for enabling the oil pressure to hydraulically activated expansible tappets to be maintained at a proper level despite temperature related changes in oil viscosity.

We claim:

1. An engine timing control tappet system of the type having at least one expansible tappet for controlling timing of a fuel injector using oil that is supplied by a pump to an engine lubrication circuit, wherein said system includes viscosity sensitive means that is coupled to the engine lubrication circuit for producing a simulated pressure which varies in correspondence with the effect of changes in the viscosity of oil received from the engine lubrication circuit on the pressure regulating means responsive to changes in said simulated pressure for adjusting the pressure of oil supplied through said engine lubrication system to said tappets from said pump, wherein said viscosity sensitive means is coupled to the engine lubrication circuit by an oil rifle connection, and comprises a viscosity orifice, a pressure chamber, a regulator connection, and an exit orifice; said viscosity orifice being connected between the rifle connection and the pressure chamber and having a flow-through length and a cross-sectional area that produces a pressure drop from an upstream side to a downstream side thereof that is sensitive to changes in viscosity of oil passing therethrough; wherein said exit orifice has, in comparison to said viscosity orifice, a relatively short flow-through length and relatively small sensitivity to the viscosity of oil passing therethrough, said exit orifice being connected to a downstream side of the pressure chamber as a means for controlling the quantity of flow through said viscosity orifice: and wherein said regulator connection communicates said pressure regulating means with said pressure chamber.

2. A viscosity responsive flow controlling system for controlling of a pump pumping variable viscosity fluid through a fluid flow circuit comprising a viscosity sensitive means connected to said flow circuit for producing a simulated fluid pressure thereat which varies in correspondence with a fluid pressure at a predetermined portion of said fluid flow circuit on the basis of the viscosity of fluid flowing through the fluid flow circuit wherein said simulated fluid pressure approximates the fluid pressure at a pressure responsive device connected in said flow circuit at a separate location from that at which said viscosity sensitive means is connected, and pressure regulating means, responsive to changes in said simulated fluid pressure, for adjusting the pressure of fluid supplied to said predetermined portion of said fluid flow circuit, wherein said viscosity sensitive means comprises a supply connection, a viscosity orifice, a pressure chamber, a regulator connection, and an exist orifice; wherein said supply connection is connected to said flow circuit; wherein said viscosity orifice is connected between said supply connection and said pressure chamber and has a flow-through length and cross-sectional area that produces a pressure drop from an upstream side to a downstream side thereof that is sensitive to changes in viscosity of fluid passing therethrough; wherein said exit orifice has, in comparison to said viscosity orifice, a relatively short flow-through length and relatively small sensitivity to the viscosity of fluid passing therethrough; said exit orifice being connected to a downstream side of the pressure chamber as a means for controlling the quantity of flow through said viscosity orifice; and wherein said regulator connection communicates said pressure regulating means with said pressure chamber.

3. An engine timing control tappet system of the type having at least one expansible tappet for controlling timing of a fuel injector using oil that is supplied by a pump to an engine lubrication circuit, wherein said system includes viscosity sensitive means that is coupled to the engine lubricating circuit for producing a simulated pressure which varies in correspondence with the effect of changes in the viscosity of oil received from the engine lubrication circuit on the pressure at said tappets, and further comprising pressure regulating means fluidically connected to said viscosity sensitive means and hydraulically responsive to changes in said simulated pressure for adjusting the pressure of oil supplied through said engine lubrication system to said tappets from said pump.

4. The tappet system of claim 2, wherein said viscosity orifice has, in comparison to said exit orifice, a large internal surface area.

5. The tappet system of claim 4, wherein said viscosity orifice has an internal surface area which is greater than that of said exit orifice by a ratio of at least 100 to 1.

6. The tappet system of claim 2, wherein the said viscosity orifice has, in comparison to said exit orifice, a relatively large flow-through area.

7. The tappet system of claim 6, wherein said viscosity orifice has a flow-through area which is greater than the flow-through area of said exit orifice by a ratio of at least 5 to 1.

8. The tappet system of claim 2, wherein said viscosity sensitive means includes a bore connecting said oil rifle connection with a drain connection, a counterbored portion extending from said drain connection at least to said regulator connection and forming said pressure chamber, and a fitting concentrically mounted in said bore to form said viscosity orifice in conjunction with said bore.

9. The tappet system according to claim 2, wherein said pressure regulating means comprises a spring-biased pressure regulating plunger exposed to the pressure of said pressure chamber by said regulator connection and operable in response to changes in pressure within said pressure chamber as a means for varying the pressure of fluid supplied to said tappets by increasing and decreasing flow through a bypass loop.

10. A viscosity responsive flow controlling system for controlling of a pump pumping variable viscosity fluid through a fluid flow circuit comprising a viscosity sensitive means connected to said flow circuit for producing a simulated fluid pressure thereat which varies in correspondence with a fluid pressure at a predetermined portion of said fluid flow circuit on the basis of the viscosity of fluid flowing through the fluid flow circuit, and pressure regulating means, responsive to changes in said simulated fluid pressure, for adjusting the pressure of fluid supplied to said predetermined portion of said fluid flow circuit wherein said viscosity sensitive means comprises a viscosity orifice having a predetermined flow-through length and cross-sectional area that produces a pressure drop from an upstream side to a downstream side thereof that is sensitive to changes in viscosity of said fluid passing therethrouh.

11. The flow controlling system of claim 10, wherein said simulated fluid pressure approximates the fluid pressure at a pressure responsive device connected in said flow circuit at a separate location from that at which said viscosity sensitive means is connected.

12. The flow controlling system of claim 2, wherein said viscosity orifice has, in comparison to said exit orifice, a large internal surface area.

13. The flow controlling system of claim 12, wherein said viscosity orifice has an internal surface area which is greater than that of said exit orifice by a ratio of at least 100 to 1.

14. The flow controlling system of claim 2, wherein said viscosity orifice has, in comparison to said exit orifice, a relatively large flow-through area.

15. The flow controlling system of claim 2, wherein said viscosity orifice has a flow-through area which is greater than the flow-through area of the said exit orifice by a ratio of at least 5 to 1.

16. The flow controlling system of claim 2, wherein: said viscosity sensitive means has a bore interconnecting the supply connection with the drain connection; and a fitting concentrically mounted in said bore, said fitting having a cylindrical portion projecting into said bore with clearance for creating said viscosity orifice therearound.

17. The flow controlling system of claim 16, wherein said fitting further comprises means for forming said exit orifice.

18. The flow controlling system according to claim 16, wherein said pressure chamber is formed by a counterbored portion of said bore in conjunction with the cylindrical portion of said fitting.

19. The flow controlling system according to claim 2, wherein said pressure regulating means comprises a spring-biased pressure regulating plunger exposed to the pressure of said pressure chamber by said regulator connection and operable in response to changes in pressure within said pressure chamber as a means for varying the pressure of fluid supplied by said pump through said fluid flow circuit by increasing and decreasing flow through a bypass loop.

* * * * *